US008095048B2

(12) United States Patent
Awano et al.

(10) Patent No.: US 8,095,048 B2
(45) Date of Patent: Jan. 10, 2012

(54) TONER CARTRIDGE MOUNTING STRUCTURE, TONER CARTRIDGE, AND IMAGE FORMING APPARATUS

(75) Inventors: Toyohiko Awano, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 62 days.

(21) Appl. No.: 12/539,000

(22) Filed: Aug. 11, 2009

(65) Prior Publication Data

US 2010/0247156 A1 Sep. 30, 2010

(30) Foreign Application Priority Data

Mar. 26, 2009 (JP) ..... 2009-077225

(51) Int. Cl.
*G03G 15/08* (2006.01)

(52) U.S. Cl. ..... 399/260; 399/119; 399/262

(58) Field of Classification Search ..... 399/107, 399/110, 111, 119, 120, 252, 255, 258, 260, 399/262

See application file for complete search history.

(56) References Cited

U.S. PATENT DOCUMENTS

| | | | | |
|---|---|---|---|---|
| 5,402,216 | A * | 3/1995 | Komaki et al. | 399/260 |
| 2005/0207795 | A1* | 9/2005 | Kubota et al. | 399/258 |
| 2007/0196136 | A1* | 8/2007 | Yamamoto et al. | 399/258 |
| 2007/0237551 | A1* | 10/2007 | Kawai | 399/258 |

FOREIGN PATENT DOCUMENTS

| | | |
|---|---|---|
| EP | 0 670 530 B1 | 5/2000 |
| JP | 6-208299 | 7/1994 |
| JP | 6-222664 | 8/1994 |
| JP | 2002-14531 | 1/2002 |
| JP | 2008-197592 | 8/2008 |

* cited by examiner

*Primary Examiner* — David Porta

*Assistant Examiner* — Benjamin Schmitt

(74) *Attorney, Agent, or Firm* — Morgan, Lewis & Bockius LLP

(57) ABSTRACT

A toner cartridge mounting structure includes a toner cartridge and a developing member. The toner cartridge having a toner accommodating portion for accommodating toner, a toner supplying opening through which the toner in the toner accommodating portion is supplied, and a supplying opening shutter for opening and closing the toner supplying opening. The developing member has a toner receiving opening and a receiving opening shutter for opening and closing the toner receiving opening. The toner supplying opening being higher than the toner receiving opening, and the supplying opening shutter being opened after the receiving opening shutter is opened, by the operation of mounting the toner cartridge in an apparatus body.

12 Claims, 12 Drawing Sheets

TONER CARTRIDGE MOUNTING STRUCTURE, TONER CARTRIDGE, AND IMAGE FORMING APPARATUS

CROSS-REFERENCE TO RELATED APPLICATION

This application is based on and claims priority under 35 USC 119 from Japanese Patent Application No. 2009-077225 filed Mar. 26, 2009.

BACKGROUND

1. Technical Field

The present invention relates to a toner cartridge mounting structure, a toner cartridge, and an image forming apparatus.

2. Related Art

In an electrophotographic image forming apparatus, a latent image is formed on a photoreceptor or the like, and the latent image is made visible by a developer, whereby image formation is carried out. The developer is conveyed toward the latent image by the rotation of a development roll.

The developer is supplied from a toner cartridge which can be removably mounted in the image forming apparatus. When the developer in the toner cartridge is exhausted, the toner cartridge is replaced with an unused toner cartridge.

SUMMARY

In view of above fact, the present invention provides a toner cartridge mounting structure, which can prevent leakage of toner when a toner cartridge is replaced, a toner cartridge, and an image forming apparatus.

According to an aspect of the invention, the toner cartridge mounting structure includes a toner cartridge and a developing member. The toner cartridge having a toner accommodating portion for accommodating toner, a toner supplying opening through which the toner in the toner accommodating portion is supplied, and a supplying opening shutter for opening and closing the toner supplying opening. The developing member has a toner receiving opening and a receiving opening shutter for opening and closing the toner receiving opening. The toner supplying opening is higher than the toner receiving opening, and the supplying opening shutter is opened after the receiving opening shutter is opened, by the operation of mounting the toner cartridge in an apparatus body

BRIEF DESCRIPTION OF THE DRAWINGS

Exemplary Embodiments of the present invention will be described in detail based on the following figures, wherein.

DETAILED DESCRIPTION

Hereinafter, an exemplary embodiment of the present invention will be described using an exemplary embodiment.

(Overall Configuration)

Figure 1:
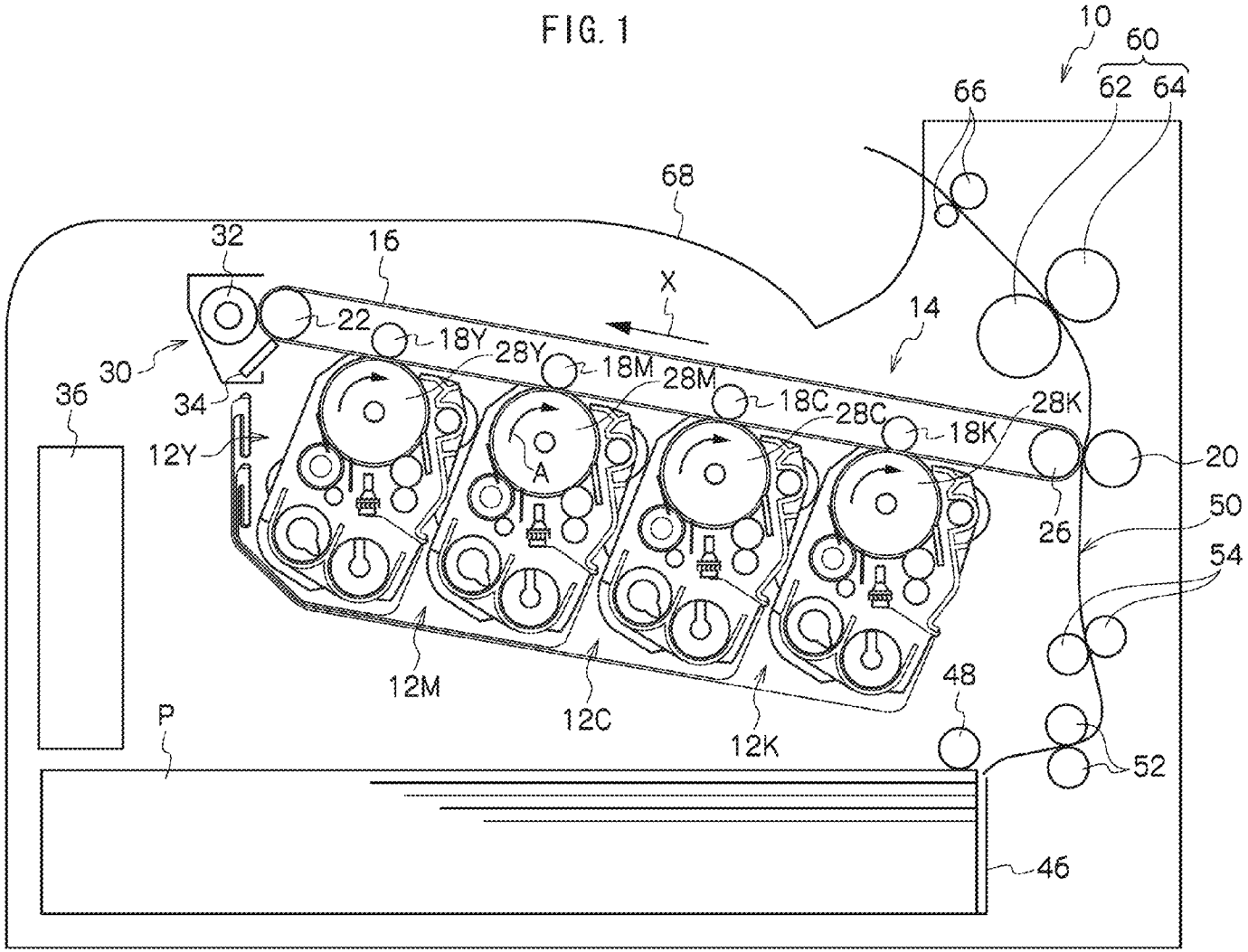
FIG. 1 is a side elevational view schematically showing an image forming apparatus according to an exemplary embodiment of the invention.

FIG. 1 shows a printer 10 as an image forming apparatus. The printer 10 is a digital printer which forms a color image or a black and while image and includes an image processing device (not shown). The image processing device applies image processing to image data sent from, for example, a personal computer.

Figure 2:
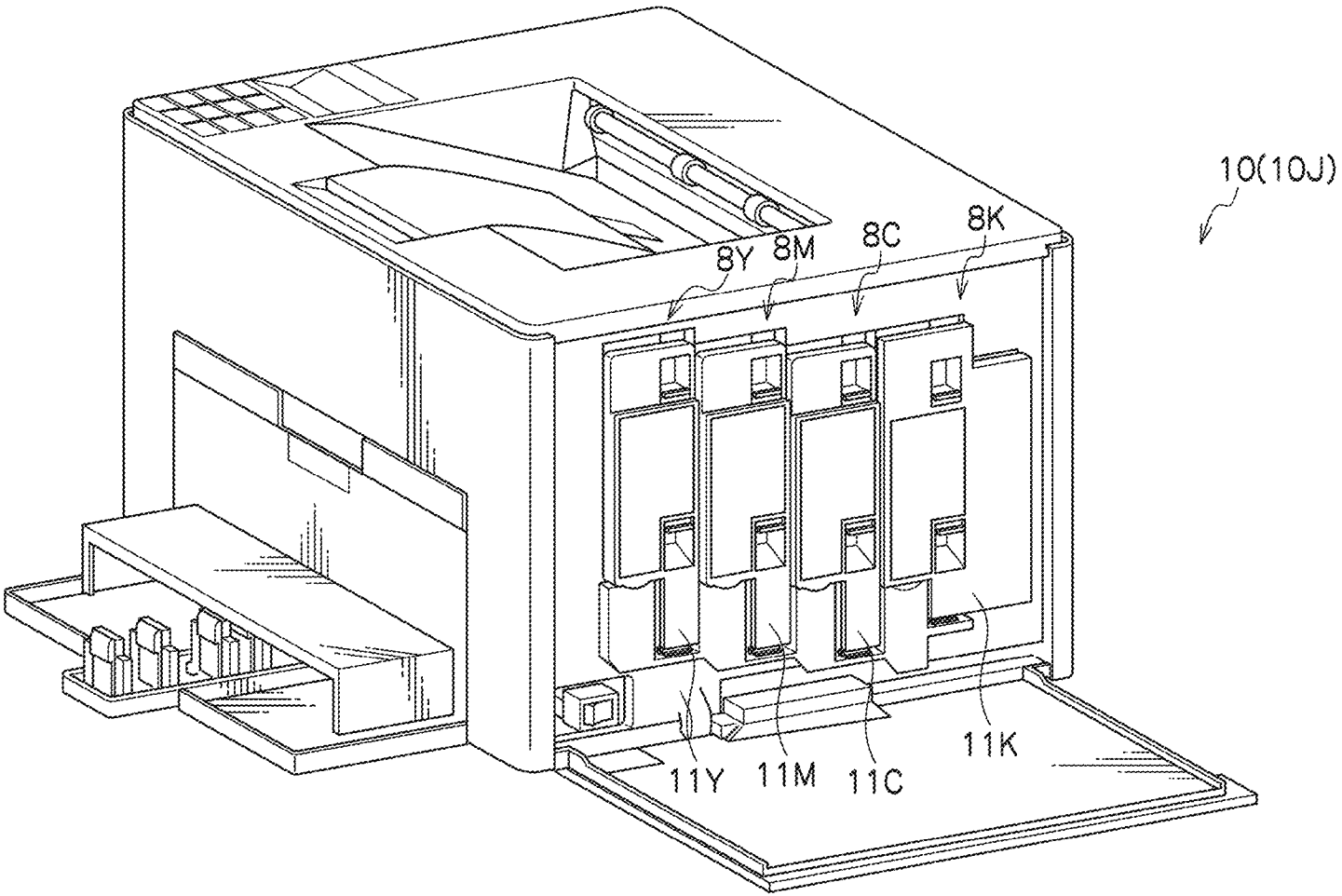
FIG. 2 is a perspective view of the image forming apparatus according to the exemplary embodiment of the invention and showing arrangement of toner cartridges.
Figure 3:
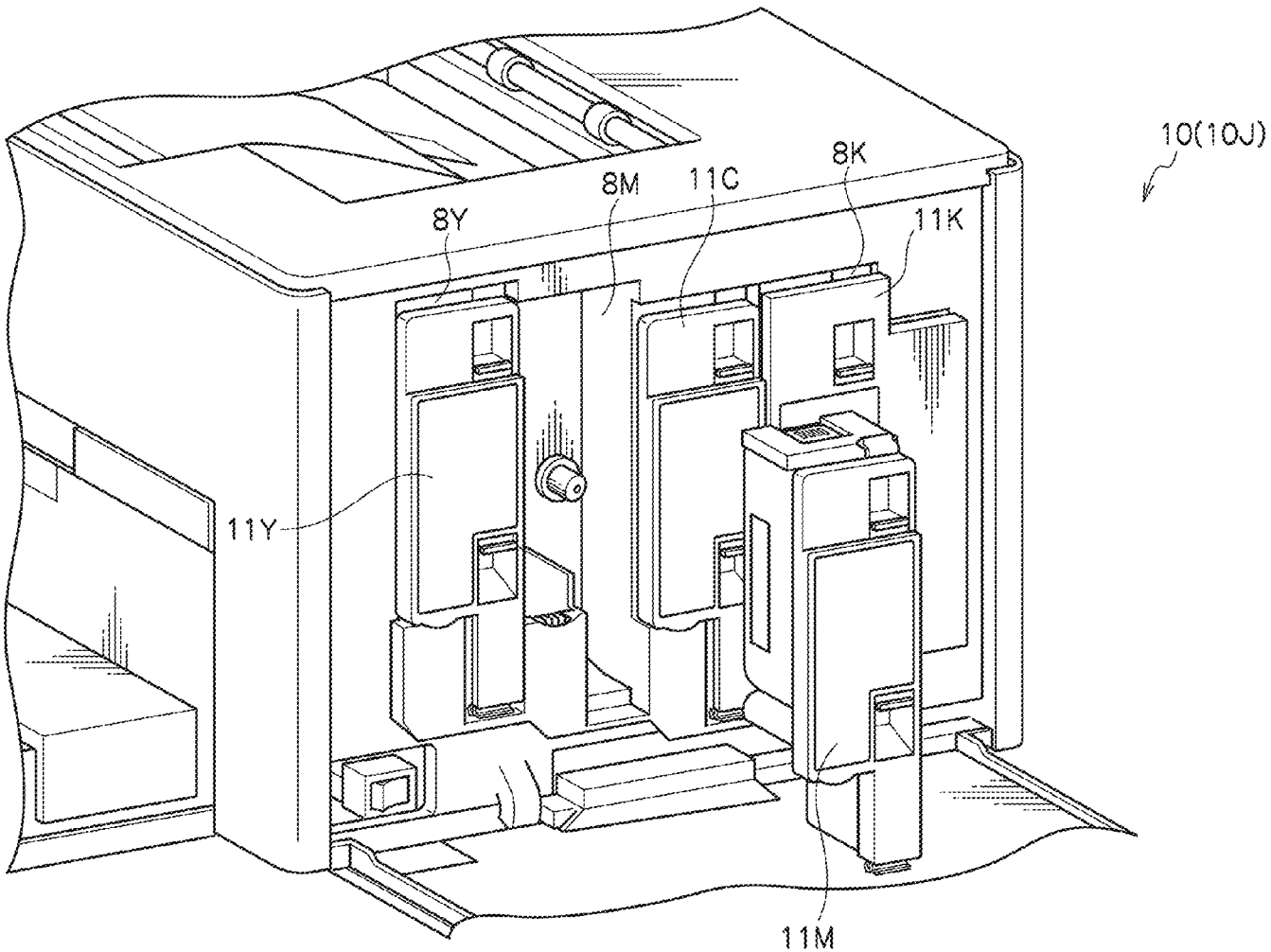
FIG. 3 is a partially enlarged perspective view of the image forming apparatus according to the exemplary embodiment of the invention and explaining attachment and detachment of the toner cartridge.

As shown in FIGS. 2 and 3, the printer 10 includes toner cartridges 11Y, 11M, 11C, and 11K mounted in the side portion of the printer 10. The toner cartridges 11Y, 11M, 11C, and 11K respectively contain yellow (Y), magenta (M), cyan (C), and black (K) toners. The printer 10 further includes cartridge containers 8Y, 8M, 8C, and 8K, which are formed in the side portion of the printer 10 according to each dimension of the toner cartridges 11Y, 11M, 11C, and 11K, and the cartridge containers 8Y, 8M, 8C, and 8K removably contain the toner cartridges 11Y, 11M, 11C,and 11K,respectively. According to this configuration, the toner cartridges 11Y, 11M, 11C, and 11K are exchangeably (removably) provided in a printer body 10J. Hereinafter, the components, respectively corresponding to yellow, magenta, cyan, and black colors, are distinguished by the letters Y, M, C, and K after their reference numerals.

Figure 4:
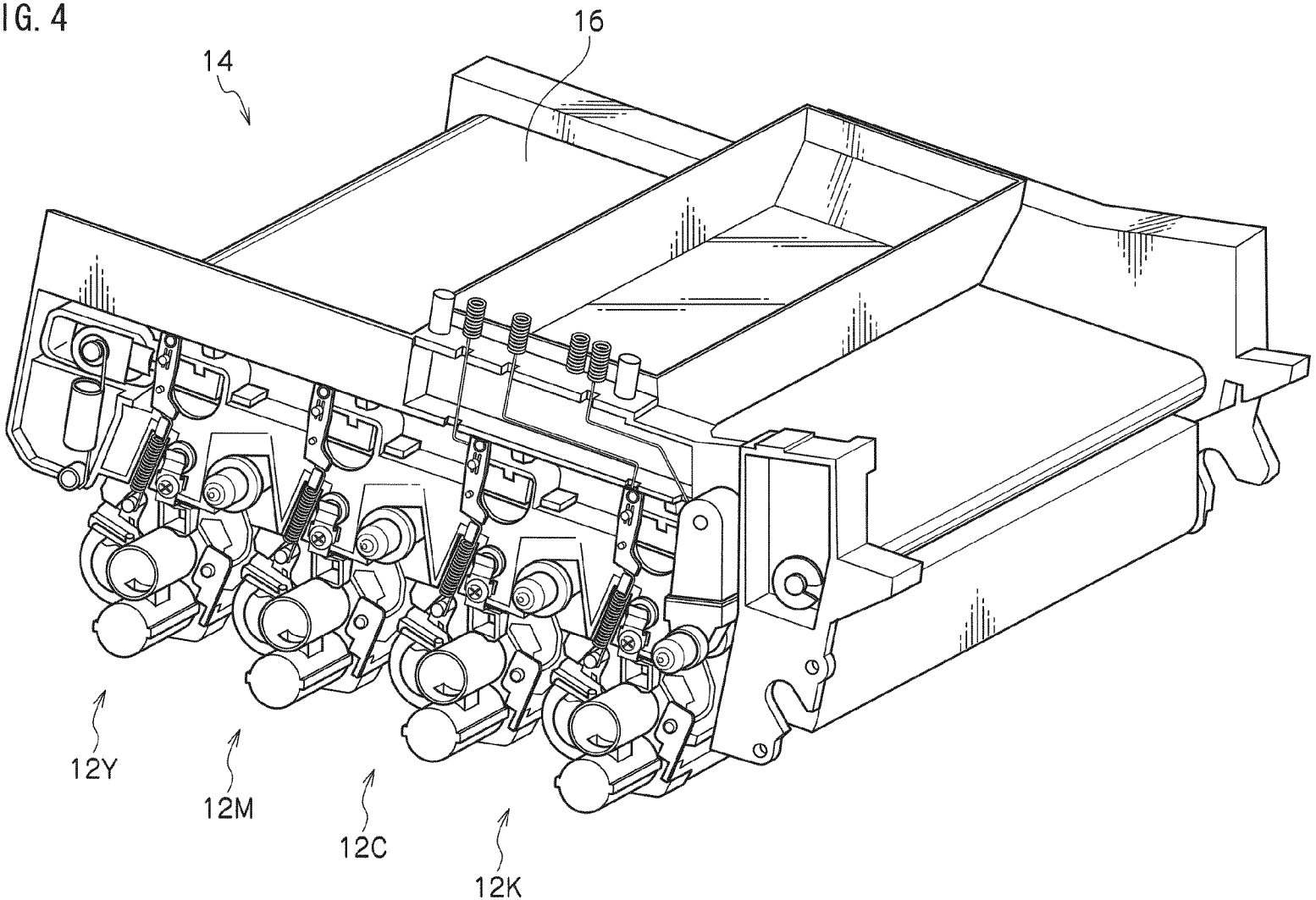
FIG. 4 is a perspective view showing an image forming unit of the image forming apparatus according to the exemplary embodiment of the invention.
Figure 5:
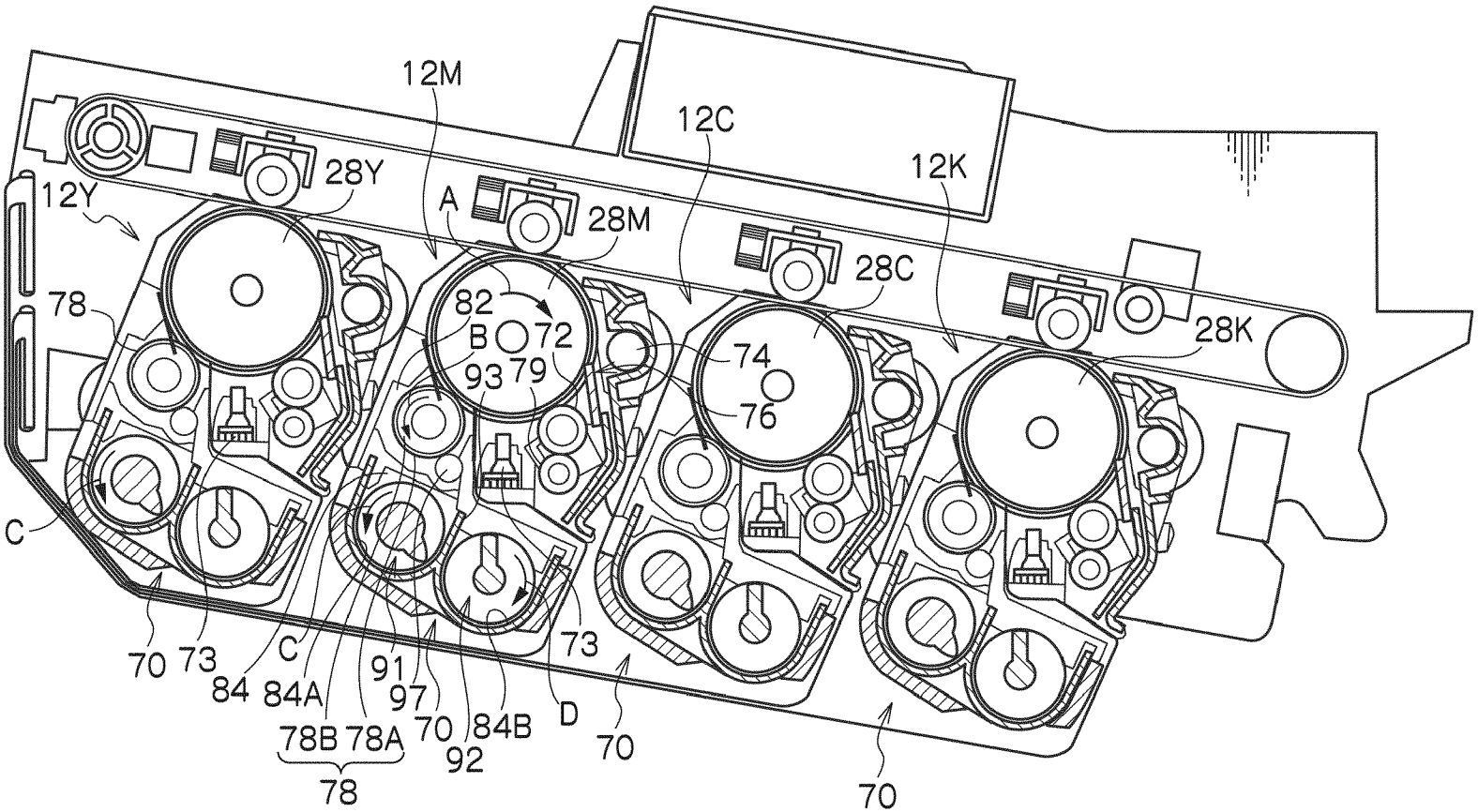
FIG. 5 is a side elevational view showing the image forming unit of the image forming apparatus according to the exemplary embodiment of the invention.

As shown in FIGS. 1, 4, and 5, the printer 10 includes four image forming units 12 (12Y, 12M, 12C, and 12K) corresponding to Y, M, C, and K developers and disposed in the central portion of the printer 10. The developer contains a mixture of a non-magnetic type toner and a carrier with magnetic properties.

A transfer unit 14 is provided above the image forming units 12Y, 12M, 12C, and 12K. The transfer unit 14 has an intermediate transfer belt 16 as an example of an intermediate transfer body, four primary transfer rolls 18Y, 18M, 18C, and 18K, which are disposed inside the intermediate transfer belt 16 and are primary transfer members which multi-transfer each toner image from the image forming units 12Y, 12M, 12C, and 12K onto the intermediate transfer belt 16, and a secondary transfer roll 20 which transfers the toner image, obtained by superposition on the intermediate transfer belt 16, onto a recording paper P.

The intermediate transfer belt 16 is wound around between a backup tension roll 22 and a drive roll 26, which is driven by a motor (not shown) disposed to face the secondary transfer roll 20, at a constant tension, and is circulatingly driven in the direction of the arrow X of FIG. 1 (counterclockwise direction) by the drive roll 26

The primary transfer rolls 18Y, 18M, 18C, and 18K are disposed to respectively face after-described photoreceptors 28 (28Y, 28M, 28C, and 28K) of the image forming units 12Y, 12M, 12C, and 12K so that the intermediate transfer belt 16 is held therebetween. The primary transfer rolls 18Y, 18M, 18C, and 18K are subjected to a transfer bias voltage, which has a polarity opposite to a toner polarity (in this exemplary embodiment, for example, a positive polarity), by a supplying unit (not shown). The secondary transfer roll 20 is also subjected to the transfer bias voltage, which has a polarity opposite to the toner polarity, by the supplying unit.

A cleaning device 30 is provided on the outer circumferential surface of the position where the backup tension roll 22 of the intermediate transfer belt 16 is provided. The cleaning device 30 has a cleaning brush 32 and a cleaning blade 34, and residual toner and paper dust on the intermediate transfer belt 16 are removed by the cleaning brush 32 and the cleaning blade 34.

A control unit 36 which performs drive control of each section of the printer 10 is provided near the side surface on the side opposite to a conveying path of the recording paper P of the printer 10.

Meanwhile, a paper cassette 46 accommodating the recording papers P is disposed below the image forming unit 12. A paper conveying path 50 through which the recording paper P is conveyed is disposed vertically above the end portion of the paper cassette 46.

The paper conveying path 50 has a paper feeding roll 48 which feeds the recording paper P from the paper cassette 46, a roll pair 52 for paper separation and conveyance, which feeds the recording papers P one by one, and a paper leading end alignment roll 54 which coincides the moving timing of an image on the intermediate transfer belt 16 with the conveying timing of the recording paper P. The recording paper P sequentially fed from the paper cassette 46 by the paper feeding roll 48 passes through the paper conveying path 50 to be once conveyed to a secondary transfer position of the intermediate transfer belt 16 by the intermittently rotating paper leading end alignment roll 54, and, thus, to be stopped.

A fixing device 60 is provided above the secondary transfer roll 20. The fixing device 60 has a heated heating roll 62 and a pressure roll 64 pushed against the heating roll 62. The recording paper P transferred with the toner images of the respective colors by the secondary transfer roll 20 is fixed by heat and pressure at a press-contact portion between the heating roll 62 and the pressure roll 64 and discharged to a discharge portion 68, which is provided in the upper portion of the printer 10, by a paper discharge roll 66, which is an example of a discharge device provided on the downstream side in the conveying direction of the recording paper P. After the secondary transfer process of the toner image, the residual toner and the paper dust on the surface of the intermediate transfer belt 16 are removed by the cleaning device 30.

(Image Forming Unit)

Next, the image forming units 12 are described. As an example, the image forming unit 12M is described. The image forming units 12Y, 12C, and 12K corresponding to other respective colors have a similar constitution to the image forming unit 12M, and the descriptions of the image forming units 12Y, 12C, and 12K are omitted. For each component of the image forming unit 12M, "M" is omitted.

As shown in FIGS. 1 and 5, the image forming unit 12 has the photoreceptor 28 rotated and driven in the direction of the arrow A (clockwise direction). Around the photoreceptor 28, there are a charge roll 72 as an example of a charge device, which contacts the surface of the photoreceptor 28 to uniformly charge the photoreceptor 28, an LED print head 73 irradiating an exposure light onto the surface of the photoreceptor 28, a developing portion 70 developing an electrostatic latent image, formed on the photoreceptor 28 by the exposure light, by developers (toner) of the respective colors, an erase lamp 74 as an example of a neutralization device, which irradiates light onto the surface of the photoreceptor 28 after transfer of the toner image and removes electricity, and a cleaning unit 76 cleaning the surface of the photoreceptor 28 after the removal of electricity.

The charge roll 72, the developing portion 70, the erase lamp 74, and the cleaning unit 76 are disposed in this order from the upstream side to the downstream side in the rotating direction of the photoreceptor 28 so as to face the surface of the photoreceptor 28.

The charge roll 72 is rotatably provided in a housing of the image forming unit 12 so as to be vertically disposed below a development roll 78 as an after-described developer holding member of the developing portion 70. A cleaning roll 79 removing toner adhered onto the surface of the charge roll 72 is rotatably provided on the opposite side of the photoreceptor 28 on the outer circumferential surface of the charge roll 72. The charge roll 72 is connected to power distribution means (not shown). The charge roll 72 is energized during image formation to thereby charge the surface of the photoreceptor 28.

The developing portion 70 has a development chamber 82 and an agitation conveyance chamber 84 provided below the development chamber 82 and agitates (mixes) the developer supplied from the toner cartridge 11 and conveys the developer to the development chamber 82.

As shown in FIG. 5, the agitation conveyance chamber 84 is partitioned by a partition wall 93 provided upright from the bottom surface and has two agitation paths of a first agitation path 84A and a second agitation path 84B. The partition wall 93 has on its both ends first and second connection openings (not shown) which are opened, and the first and second agitation paths 84A and 84B are connected through the first and second connection ports. The upper surface of the first agitation path 84A is opened and connected to the development chamber 82.

The second agitation path 84B has on its one end a protruding portion 90 (see, FIGS. 6 and 7) projecting toward the outer side than the end surface of the first agitation path 84A. The protruding portion 90 has on its upper surface an after-described opening 120 through which the toner from the toner cartridge 11 is supplied.

A first agitation conveying member 91 is disposed in the first agitation path 84A. Likewise, a second agitation conveying member 92 is disposed in the second agitation path 84B.

The first and second agitation conveying members 91 and 92 are driven by drive means including a motor and a gear (not shown). The first agitation conveying member 91 rotates in the direction of the arrow C, and the second agitation conveying member 92 rotates in the direction of the arrow D (these two directions are different). Thus, the developer in the agitation conveyance chamber 84 is mixed and agitated with the supplied toner to be conveyed in the first and second agitation paths 84A and 84B to circulate between the first agitation path 84A and the second agitation path 84B.

As shown in FIG. 5, the development chamber 82 is connected with the first agitation path 84A. The development chamber 82 includes the development roll 78, which rotates in the direction of the arrow B (counterclockwise direction) and whose axial direction is the longitudinal direction of the photoreceptor 28. The development chamber 82 further includes a thin layer forming roll 97 as a layer regulating member.

The thin layer forming roll 97 is disposed upstream of the photoreceptor 28 in the rotating direction of the development roll 78 and spaced from the outer circumferential surface of the development roll 78. The thin layer forming roll 97 regulates the passing amount of the developer on the development roll 78 and forms a developer layer (thin layer) having a predetermined thickness on the development roll 78.

The development roll 78 is disposed to face the outer circumferential surface of the photoreceptor 28 through an opening (not shown) formed in the development chamber 82. The development roll 78 includes a magnet roll 78B as magnetic field generation means fixed to the development chamber 82 and a developing sleeve 78A as a tubular rotating body, which has a hollow-cylinder shape and is rotatably provided around the outer circumference of the magnet roll 78B. A bias voltage is applied to between the development roll 78 and the photoreceptor 28, and a magnetic field is formed. The toner in the developer is moved toward the latent image on the photoreceptor 28 during development.

(Toner Cartridge and the Attaching/Detaching Mechanism)

Figure 9:
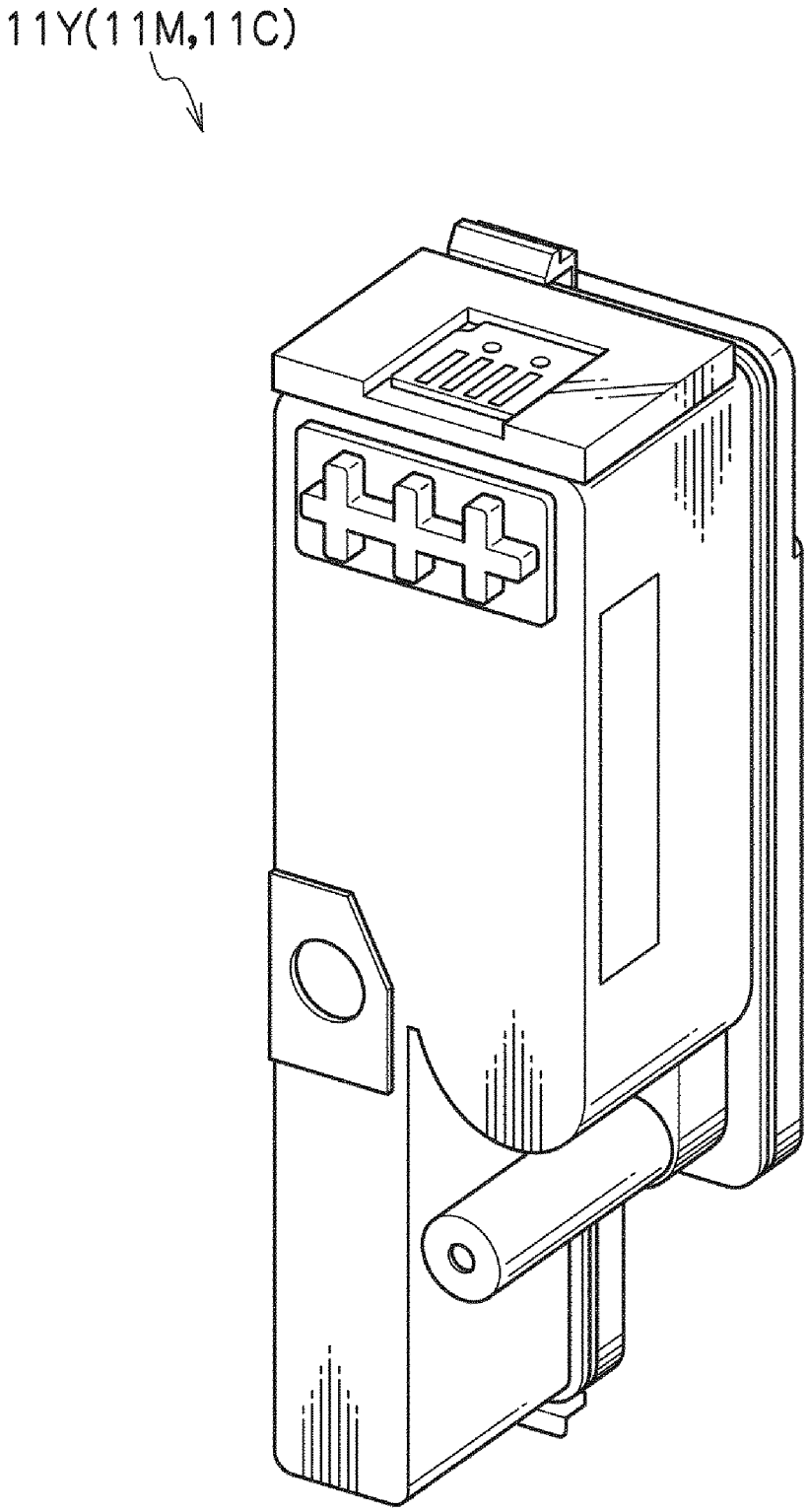
FIG. 9 is a perspective view of the toner cartridge of the image forming apparatus according to the exemplary embodiment of the invention.
Figure 10:
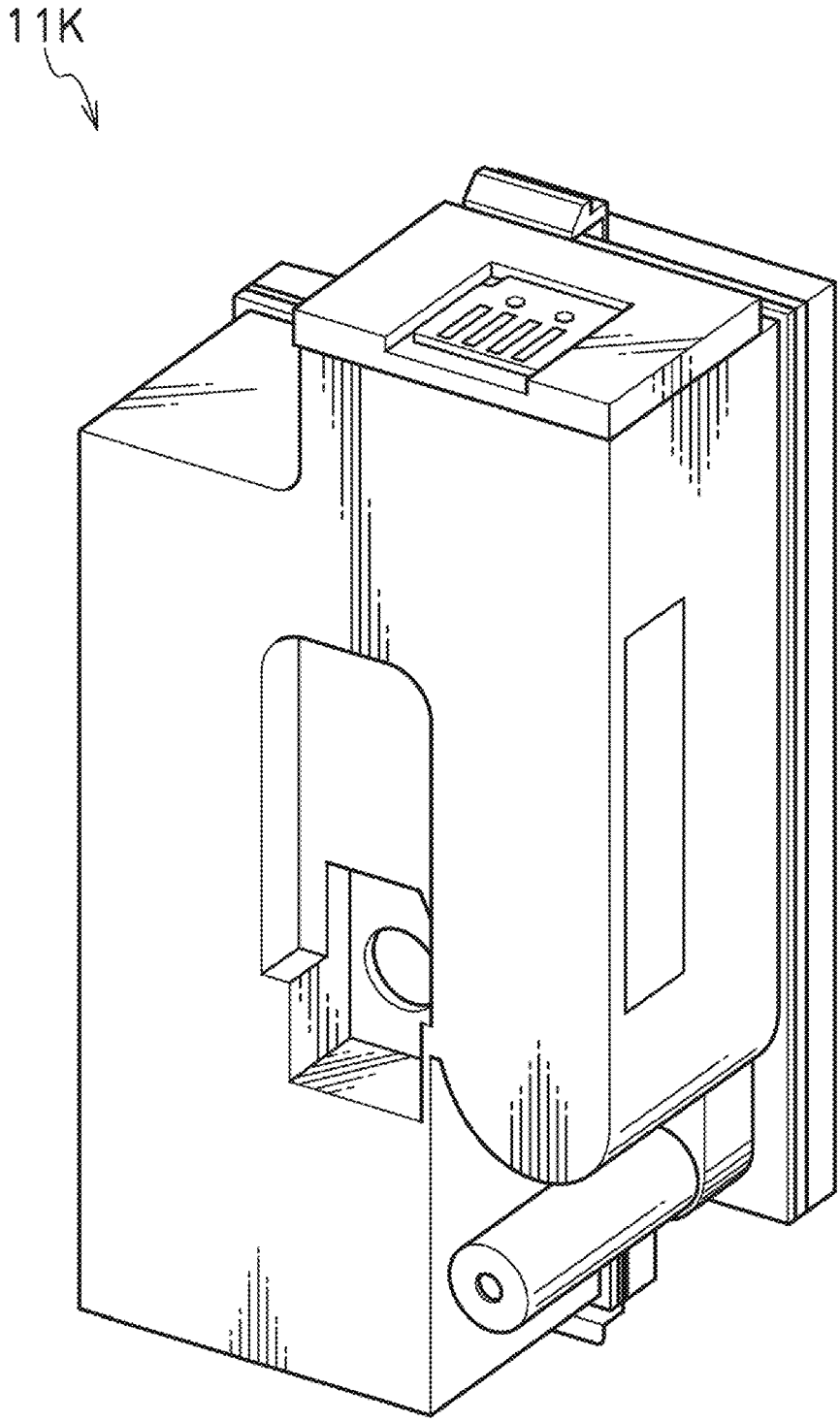
FIG. 10 is a perspective view of the toner cartridge of the image forming apparatus according to the exemplary embodiment of the invention.
Figure 11:
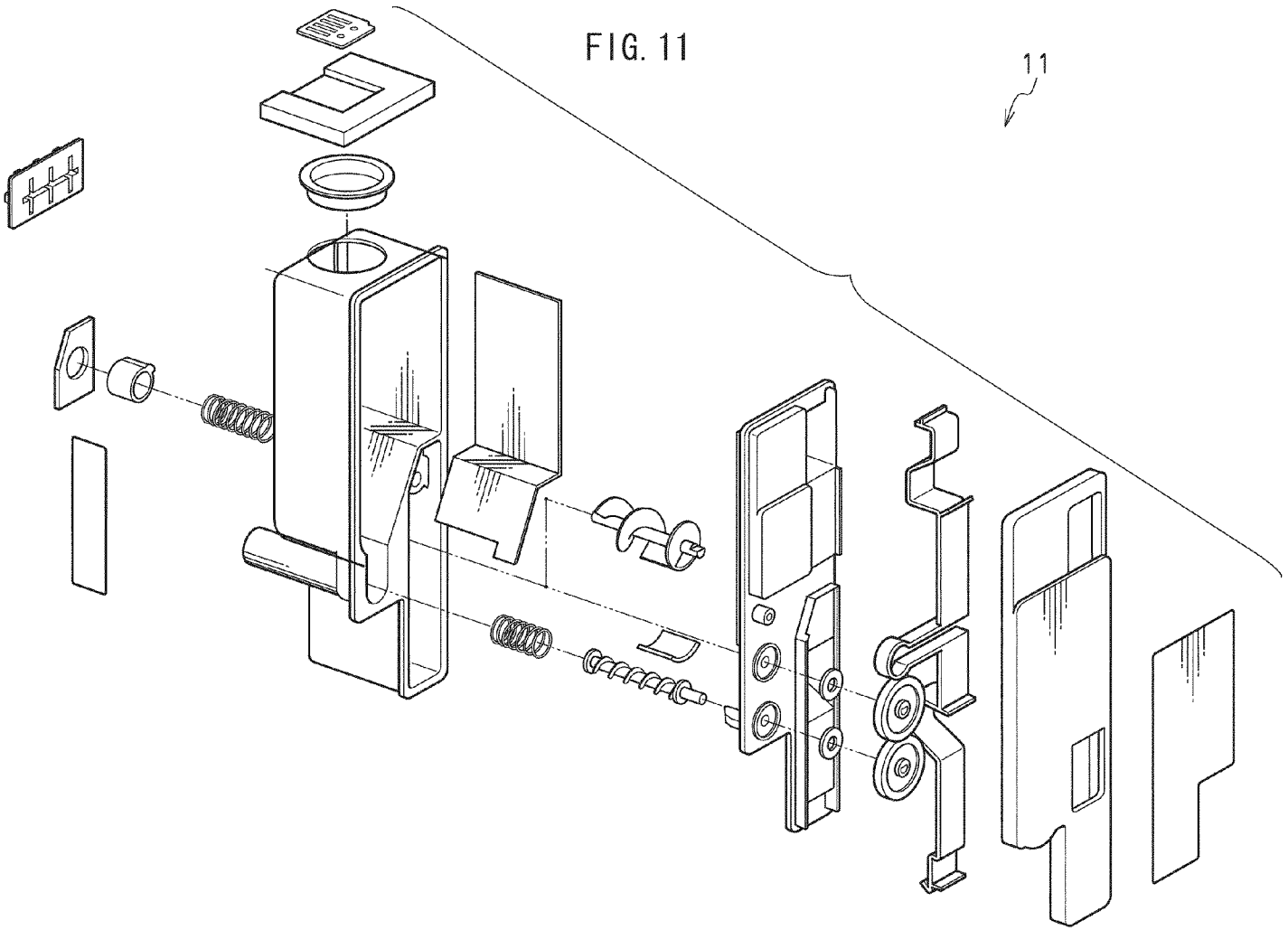
FIG. 11 is an exploded perspective view of the toner cartridge of the image forming apparatus according to the exemplary embodiment of the invention.

Next, a toner cartridge and the attaching/detaching mechanism are described. As an example, the toner cartridge 11M is described. The toner cartridges 11Y and 11C have a similar constitution to the toner cartridge 11M. Further, as shown in FIGS. 9 and 10, although the toner cartridge 11K is different in dimension from the toner cartridge 11M, the toner cartridge 11K has a principle of the attaching/detaching mechanism to the printer body 10J, that is similar to that of the toner cartridge 11M. Thus, the descriptions of the toner cartridges 11Y, 11C, and 11K are omitted. For each component of the toner cartridge 11M, "M" is omitted.

As shown in FIGS. 2, 3, 6, and 7, the toner cartridge 11 is pushed into the cartridge container 8 to be mounted in the printer body 10J. Meanwhile, the toner cartridge 11 is drawn out from the cartridge container 8 to be detached from the printer body 10J.

Figure 6:
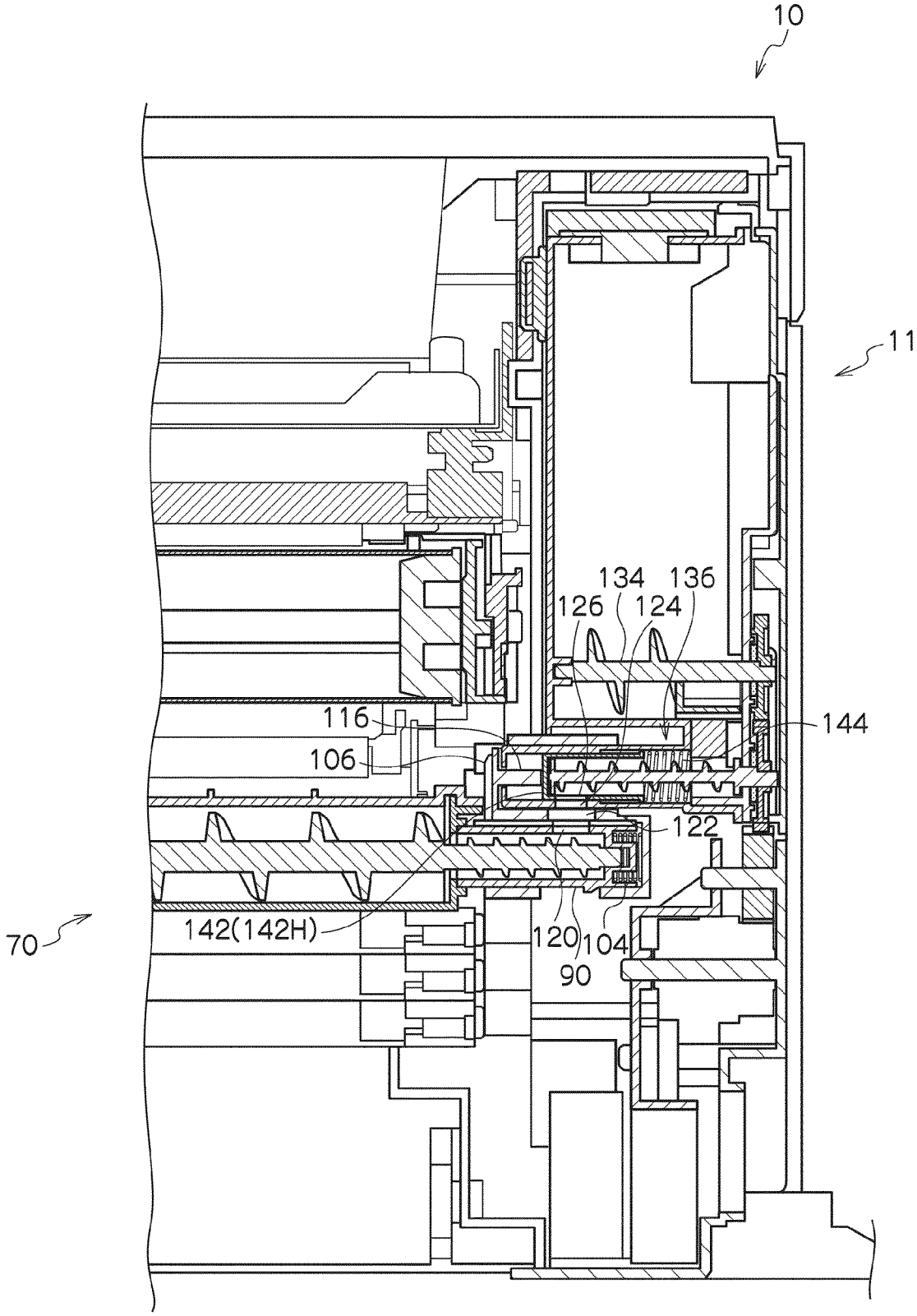
FIG. 6 is a side elevational view showing a mounting mechanism for a toner cartridge of the image forming apparatus according to the exemplary embodiment of the invention.
Figure 7:
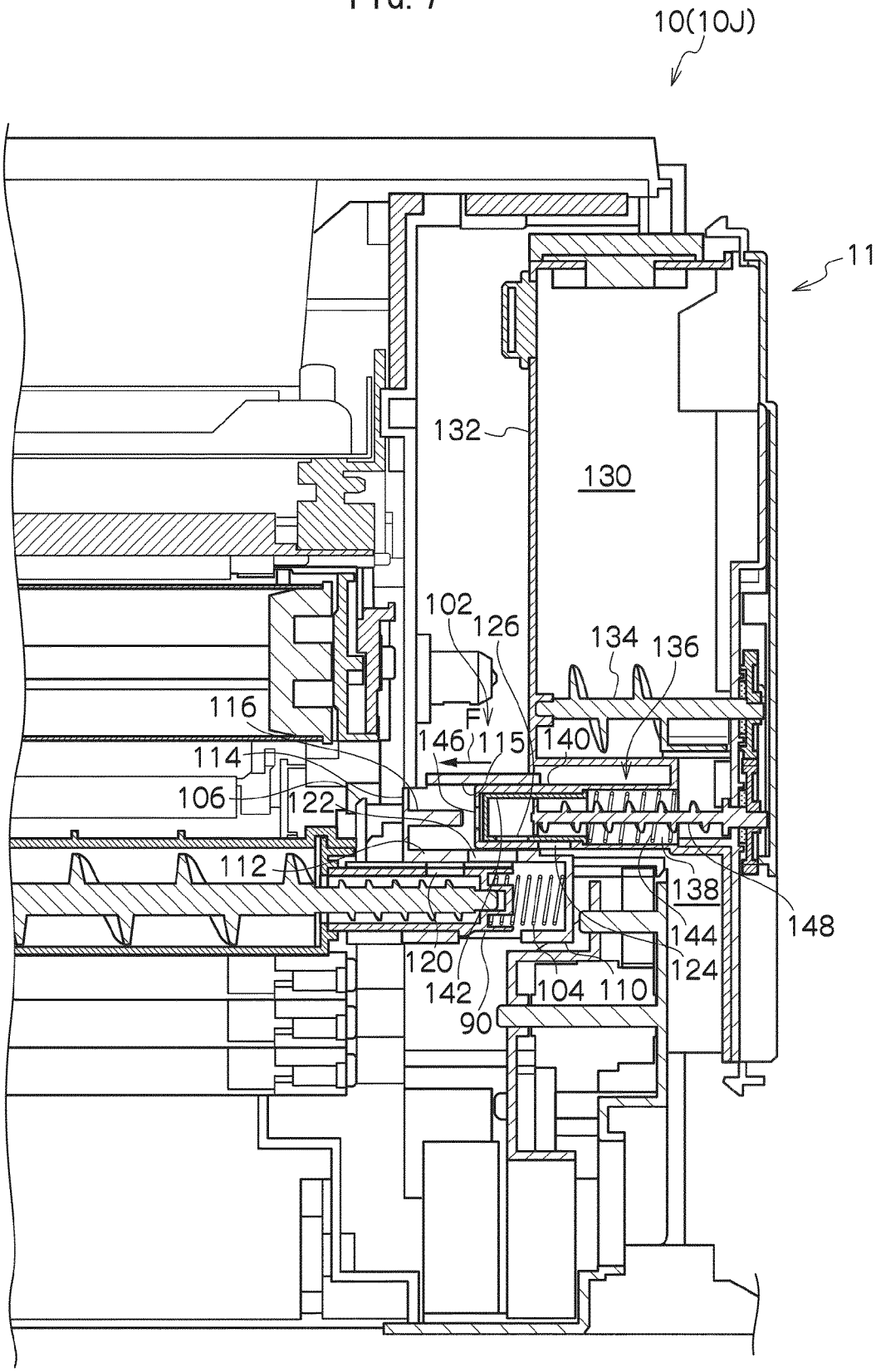
FIG. 7 is a side elevational view showing the mounting mechanism for the toner cartridge of the image forming apparatus according to the exemplary embodiment of the invention.
Figure 8:
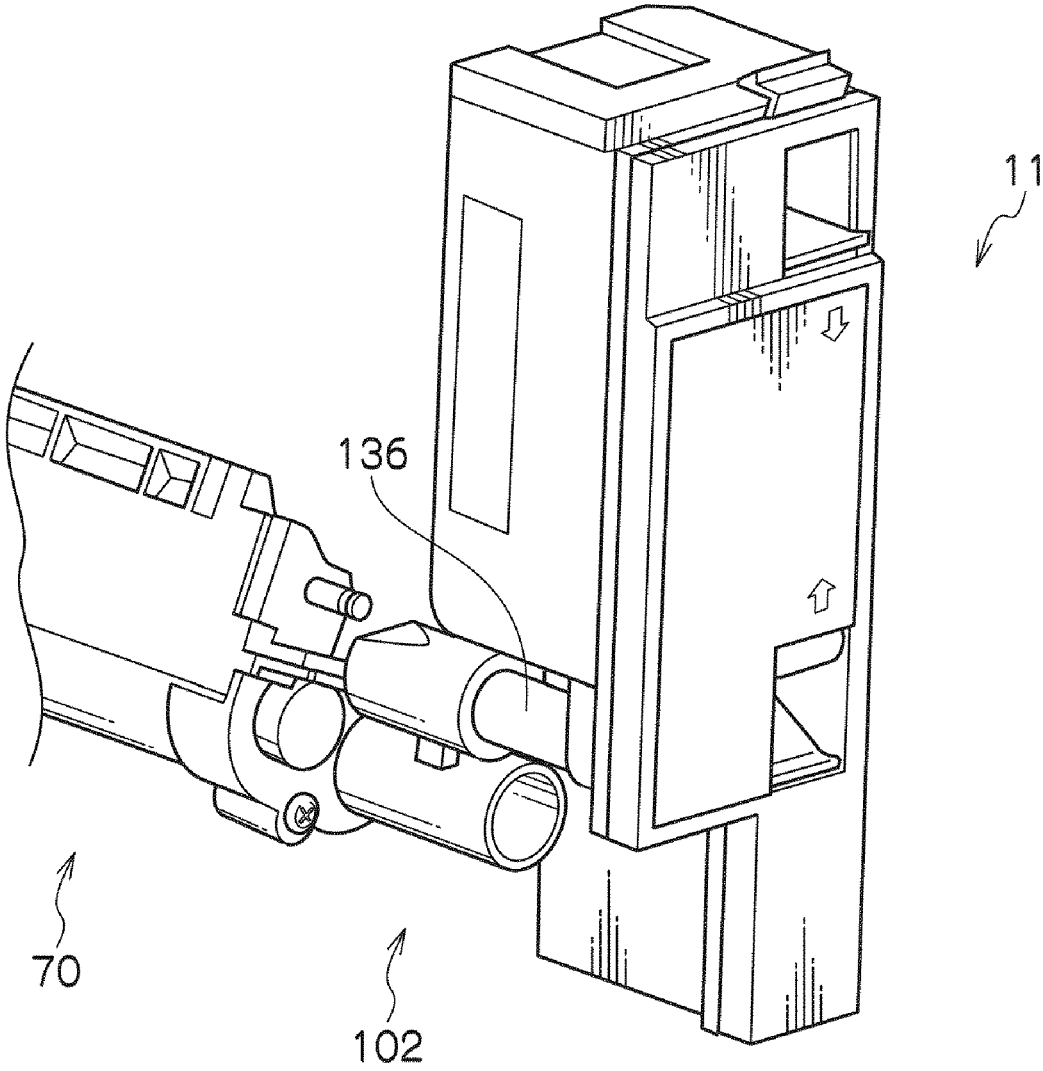
FIG. 8 is a perspective view of the image forming apparatus according to the exemplary embodiment of the invention and showing a positional relationship between a developing portion and the toner cartridge.

As shown in FIGS. 6 and 7, the developing portion 70 of the image forming unit 12 has a developing portion shutter 102 slidably moving along the longitudinal direction of the protruding portion 90, a developing portion compression coil spring 104 biasing the developing portion shutter 102 toward the outside of the printer 10, and a stopper 106 regulating the moving range of the developing portion shutter 102 in a mounting direction F.

The developing portion shutter 102 has a shutter lower portion 110 located outside the developing portion 70 in the longitudinal direction, a shutter intermediate portion 112 extending from the shutter lower portion 110 in the mounting direction F, and a shutter upper portion 114 extending from the upper portion of the shutter intermediate portion 112. A tubular portion 115, through which a toner supplying portion 136 described below is inserted includes the shutter intermediate portion 112 and the shutter upper portion 114. The shutter upper portion 114 has a bar-shaped protruding portion 116 which contacts a head portion 142H (see, FIG. 12A) of a cartridge shutter 142 described below. The developing portion compression coil spring 104 contacts the shutter lower portion 110 from the inside of the shutter lower portion 110 to apply a biasing force to the shutter lower portion 110.

The protruding portion 90 of the developing portion 70 has an opening (toner receiving opening) 120 formed in the upper portion in the set position. The shutter intermediate portion 112 also has an opening 122. The opening 122 is formed so that when the developing portion shutter 102 abuts the stopper 106, the opening 122 is substantially aligned with the opening 120. When the toner cartridge 11 is not mounted in the printer 10, the developing portion shutter 102 extends to the accommodating position of the toner cartridge 11 by the biasing force of the developing portion compression coil spring 104, and the opening 122 of the developing portion shutter 102 is not substantially aligned with (connect with) the opening 120 of the protruding portion 90.

As shown in FIGS. 6 to 11, the toner cartridge 11 has a cartridge body 132 forming a toner accommodation chamber 130, a cartridge body agitation conveyance chamber 134 provided in the cartridge body 132, and the toner supplying portion 136 continued to the lower portion of the cartridge body 132.

The toner supplying portion 136 has an elongated toner supplying chamber 138 connected to the toner accommodation chamber 130. The toner supplying portion 136 further has a supplying housing 140 extending in the mounting direction F of the printer 10, a cartridge shutter 142 that can move forward and backward in the supplying housing 140, and a supplying compression coil spring 144 that biases the cartridge shutter 142 in the mounting direction F of the printer 10. The supplying housing 140 is integrally formed with a housing of the cartridge body 132. The supplying housing 140 has an opening hole 146 in the mounting direction F, and the protruding portion 116 of the developing portion 70 is inserted through the opening hole 146. The biasing force of the developing portion compression coil spring 104 is smaller than the biasing force of the supplying compression coil spring 144.

The toner supplying chamber 138 includes the supplying housing 140 and the cartridge shutter 142. The toner supplying portion 136 has a supplying agitation conveyance member 148 extending into the toner supplying chamber 138.

The cartridge shutter 142 has an opening 126 formed in the lower portion thereof. The supplying housing 140 also has an opening 124 formed in the lower portion thereof. The openings 124 and 126 are formed so that when the toner cartridge 11 is mounted in the printer 10, they are substantially aligned with the openings 120 and 122. When the toner cartridge 11 is not mounted in the printer 10, the cartridge shutter 142 extends due to the biasing force of the supplying compression coil spring 144, and the opening 126 of the cartridge shutter 142 does not connect with (is not aligned with) the opening 124 of the supplying housing 140.

As shown in FIG. 6, when the toner cartridge 11 is mounted in the printer 10, the positions of the developing portion 70 and the mounting position of the toner cartridge 11 are determined such that the toner supplying portion 136 is located above the developing portion shutter 102.

Next, the image formation process of the printer 10 is described.

As shown in FIG. 1, the image data to which the image processing is applied by an image processing device (not shown) is further converted into color material gradation data of yellow (Y), magenta (M), cyan (C), and black (K) colors. Each exposure light L corresponding to the color material gradation data of each color is emitted, and scanning exposure is performed onto each of the photoreceptors 28, whereby the latent image (electrostatic latent image) is formed.

As shown in FIGS. 1, 4, and 5, the electrostatic latent image formed on the photoreceptor 28 is elicited as a toner image (developer image) of each color of yellow (Y), magenta (M), cyan (C), and black (K) by the developing portion 70, and development is performed. The toner images of the respective colors sequentially formed on the photoreceptors 28 of the image forming units 12Y, 12M, 12C, and 12K are sequentially multi-transferred onto the intermediate transfer belt 16 by the four primary transfer rolls 18Y, 18M, 18C, and 18K.

The toner image of each color multi-transferred onto the intermediate transfer belt 16 is secondarily transferred onto the recording paper P conveyed by the secondary transfer roll 20. The toner image of each color on the recording paper P is fixed by the fixing device 60, and the recording paper P fixed with the toner image is discharged into a discharge tray 68.

After the process of transferring the toner image is terminated, the residual toner and the paper dust on the surface of the photoreceptor 28 are removed by the cleaning unit 76. Further, the residual toner and the paper dust on the intermediate transfer belt 16 are removed by the cleaning device 30.

Next, the operation and effect of the exemplary embodiment of this invention are described.

Figure 12A:
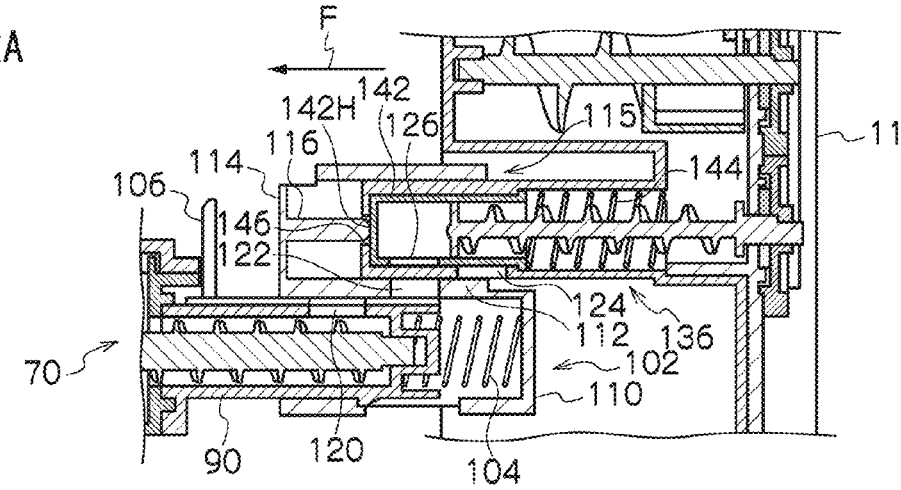
FIG. 12A is a side elevational view of the image forming apparatus according to the exemplary embodiment of the invention and explaining mounting of the toner cartridge.

When the toner cartridge 11 is mounted in the printer 10 (the printer body 10J), a side cover on the toner cartridge side of the printer 10 is opened, the toner cartridge 11 is positioned to the mounting position, and the toner supplying portion 136 is inserted into the tubular portion 115 of the developing portion shutter 102. Thereby, the toner cartridge 11 reaches the entrance of the cartridge container 8, and, as shown in FIG. 12A, the bar-shaped protruding portion 116 of the developing portion shutter 102 enters through the opening hole 146 of the supplying housing 140 and abuts the head portion 142H of the cartridge shutter 142.

The toner cartridge 11 is then moved in the mounting direction F. Since the biasing force of the developing portion compression coil spring 104 is smaller than the biasing force of the supplying compression coil spring 144, the developing portion shutter 102 is pressed by the cartridge shutter 142 to move in the mounting direction F against the biasing force of the developing portion compression coil spring 104.

Figure 12B:
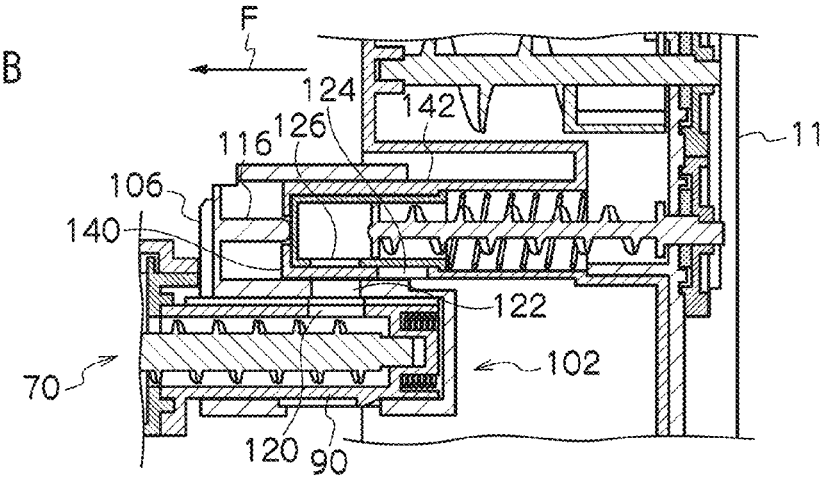
FIG. 12B is a side elevational view of the image forming apparatus according to the exemplary embodiment of the invention and explaining mounting of the toner cartridge.

When the developing portion shutter 102 moves to a movable end in the mounting direction F, as shown in FIG. 12B, the movement of the developing portion shutter 102 is stopped by the stopper 106, and, at the same time, the opening 122 of the developing portion shutter 102 comes to be located above the opening 120 of the protruding portion 90, and the opening 120 and the opening 122 are thereby connected to each other. At this time, although the opening 126 of the cartridge shutter 142 is located above the openings 120 and 122, the supplying housing 140 prevents the opening 126 from being aligned with (connecting to) the openings 120 and 122.

When the toner cartridge 11 is further moved in the mounting direction F, the toner cartridge 11 is moved in the mounting direction F in a state in which the movement of the cartridge shutter 142 is stopped by the protruding portion 116. Namely, the cartridge shutter 142 moves relative to the toner cartridge 11 in the direction opposite to the mounting direction F.

Figure 12C:
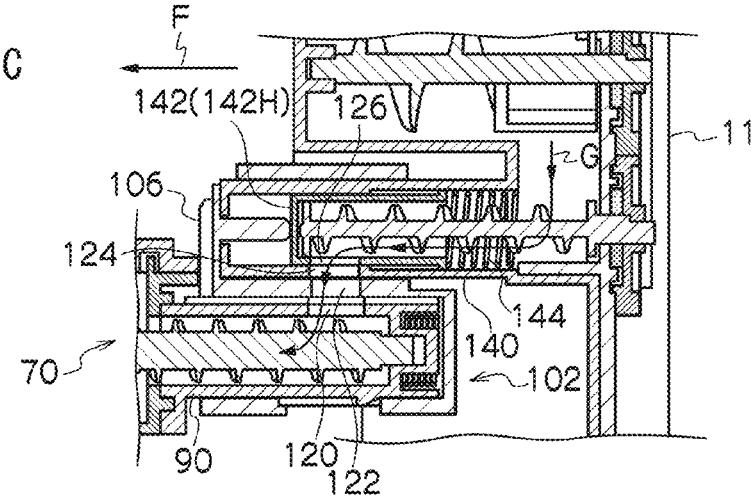
FIG. 12C is a side elevational view of the image forming apparatus according to the exemplary embodiment of the invention and explaining mounting of the toner cartridge.

When the toner cartridge 11 is moved in the mounting direction F until the mounting of the toner cartridge 11 is terminated, as shown in FIG. 12C, the opening 124 of the supplying housing 140 moves to the position of the opening 126 of the cartridge shutter 142. Thereby, the openings 120, 122, 124 and 126 are substantially vertically aligned, and toner (developer) G drops from the toner cartridge 11 into the protruding portion 90, that is, it is supplied to within the developing portion 70.

As described above, in the exemplary embodiment, when the toner cartridge 11 is mounted in the printer 10, the opening 120 of the protruding portion 90 of the developing portion 70 and the opening 122 of the developing portion shutter 102 are first substantially aligned, that is, the openings 120 and 122, provided on the developing portion side and receiving the toner, substantially align to form an opening. Thereafter, the openings 124 and 126 on the toner cartridge side substantially align to form an opening, and the toner drops into the openings 122 and 120 on the developing portion side to be supplied to the developing portion 70. Thus, leakage of toner can be reliably prevented when the toner cartridge 11 is mounted, and contamination can be effectively prevented.

When the toner cartridge 11 is removed for replacement, the toner cartridge 11 is pulled out at a near side (in the direction opposite to the mounting direction F; see FIGS. 6 and 7). Thereby, the openings 124 and 126 on the toner cartridge side are not aligned and thus are closed, and thereafter, the openings 120 and 122 on the developing portion side are not aligned and thus are closed. Thus, the leakage of toner can be reliably prevented even when the toner cartridge 11 is removed, and contamination can be effectively prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner cartridge mounting structure comprising:

a toner cartridge having a toner accommodating portion for accommodating toner, a toner supplying opening through which the toner in the toner accommodating portion is supplied, and a supplying opening shutter for opening and closing the toner supplying opening; and a developing member having a toner receiving opening and a receiving opening shutter for opening and closing the toner receiving opening, the toner supplying opening being higher than the toner receiving opening and the supplying opening shutter being opened after the receiving opening shutter is opened, by the operation of mounting the toner cartridge in an apparatus body, wherein the toner cartridge further has a toner supplying portion connected to the toner accommodating portion, the toner supplying opening is formed in the toner supplying portion, and the supplying opening shutter is contained in the toner supplying portion.

2. An image forming apparatus comprising the toner cartridge mounting structures of claim 1.

3. The toner cartridge mounting structure of claim 1, wherein the toner supplying opening is formed in an exterior surface of a toner supplying portion, and the supplying opening shutter is contained in the toner supplying portion while touching an internal surface of the toner supplying portion.

4. A toner cartridge mounting structure comprising:

a toner cartridge having:

a toner accommodating portion for accommodating toner, a toner supplying opening through which the toner in the toner accommodating portion is supplied, a supplying opening shutter that slidably moves and that has a first opening that is able to be substantially aligned with the toner supplying opening to form an opening with the toner supplying opening, and a first biasing member biasing the supplying opening shutter in the closing direction thereof; and a developing member having:

a toner receiving opening, the toner receiving opening being lower than the toner supplying opening, a receiving opening shutter that has a second opening that is able to be substantially aligned with the toner receiving opening to form an opening with the toner receiving opening, and that is pressed with the supplying opening shutter by the operation of mounting the toner cartridge in an apparatus body such that the receiving opening shutter slidably moves, a second biasing member biasing the receiving opening shutter in the closing direction thereof, and an abutting member that abuts the receiving opening shutter so that the second opening is substantially aligned with the toner receiving opening, and that regulates the sliding movement of the receiving opening shutter, wherein the toner cartridge further has a toner supplying portion connected to the toner accommodating portion, the toner supplying opening is formed in the toner supplying portion, and the supplying opening shutter is contained in the toner supplying portion.

5. The toner cartridge mounting structure of claim 4, wherein the biasing force of the second biasing member is smaller than the biasing force of the first biasing member.

6. The toner cartridge mounting structure of claim 4, wherein the receiving opening shutter comprises a tubular portion through which the toner supplying portion is inserted.

7. The toner cartridge mounting structure of claim 4, wherein the receiving opening shutter comprises a bar-shaped protruding portion, and the protruding portion is inserted through an opening hole of the toner supplying portion by the operation of mounting the toner cartridge in the apparatus body, and abuts the supplying opening shutter.

8. An image forming apparatus comprising the toner cartridge mounting structures of claim 4.

9. The toner cartridge mounting structure of claim 4, wherein the toner supplying opening is formed in an exterior surface of a toner supplying portion, and the supplying opening shutter is contained in the toner supplying portion while touching an internal surface of the toner supplying portion.

10. A toner cartridge comprising:

a toner accommodating portion for accommodating toner;

a toner supplying opening through which the toner in the toner accommodating portion is supplied; and a supplying opening shutter for opening and closing the toner supplying opening, when the toner cartridge is mounted in an apparatus body, the toner supplying opening being higher than a toner receiving opening of a developing member of the apparatus body, and the supplying opening shutter being opened after a receiving opening shutter for opening and closing the toner receiving opening is opened by the operation of mounting the toner cartridge in the apparatus body;

wherein the toner cartridge further has a toner supplying portion connected to the toner accommodating portion, the toner supplying opening is formed in the toner supplying portion, and the supplying opening shutter is contained in the toner supplying portion.

11. An image forming apparatus comprising the toner cartridge of claim 10.

12. The toner cartridge of claim 10, wherein the toner supplying opening is formed in an exterior surface of the toner supplying portion, and a supplying opening shutter is contained in the toner supplying portion while touching an internal surface of the toner supplying portion.

* * * * *